United States Patent [19]

Schubert et al.

[11] Patent Number: 4,607,518

[45] Date of Patent: Aug. 26, 1986

[54] FORGING PRESS OF UNDERFLOOR DESIGN

[75] Inventors: Hans A. Schubert, Düsseldorf; Klaus Schulze, Monchen-Gladbach, both of Fed. Rep. of Germany

[73] Assignee: SMS HasenClever Maschinenfabrik GmbH, Dusseldorf, Fed. Rep. of Germany

[21] Appl. No.: 746,323

[22] Filed: Jun. 19, 1985

[30] Foreign Application Priority Data

Jun. 19, 1984 [DE] Fed. Rep. of Germany ..... 3422644

[51] Int. Cl.[4] ..... B21J 9/12

[52] U.S. Cl. ..... 72/453.12; 72/455; 72/453.18

[58] Field of Search ..... 72/453.01, 45.12, 453.09, 72/453.18, 455; 100/269 R

[56] References Cited

U.S. PATENT DOCUMENTS

| | | | |
|---|---|---|---|
| 2,893,023 | 7/1959 | Crandey | 72/453.12 |
| 3,408,849 | 11/1968 | Jetschmann | 72/453.12 |
| 4,291,571 | 9/1981 | Claussen | 72/453.18 |

*Primary Examiner*—Leon Gilden

*Attorney, Agent, or Firm*—Holman & Stern

[57] ABSTRACT

In a forging press of underfloor construction, the vertically travelling frame has a lower crosshead which fits around and is guided on a hollow guide shaft which projects downwards from the table crosshead or platten of the press. The hollow guide shaft serves also as the working cylinder of the press. A working plunger piston which is slidable in the cylinder is coupled to the lower travelling crosshead of the press frame through spherical jointing to eliminate transverse forces on the piston.

11 Claims, 6 Drawing Figures

FORGING PRESS OF UNDERFLOOR DESIGN

BACKGROUND OF THE INVENTION

The invention relates to a forging press of underfloor design having a travelling frame, which press comprises a stationary crosshead or platen and a travelling frame formed by an upper and lower travelling crosshead and columns connecting these.

At least one hydraulic piston-cylinder unit for effecting the working stroke is provided acting between the platen and the lower travelling crosshead, while at least one additional piston-cylinder unit for the retraction of the travelling frame is disposed to act between the platen and the upper travelling crosshead. In order to relieve the columns of forging presses of this type from the bending stresses caused by eccentric forging resistance, it is known to provide the underside of the platen with a guide shaft on which the lower travelling crosshead is guided, the guides in the lower travelling crosshead diverting the moment due to the eccentric forging resistance to the guide shaft (Ernst Müller "Hydraulische Pressen und Druckflüssigkeitsanlagen" [Hydraulic Presses and Pressure Fluid Plants], Vol. 1 "Schmiedepressen" [Forging Presses], 3rd edition, Springer-Verlag, 1962, pp. 33, 34, FIG. 29). On account of the central arrangement of the guide shaft, two working-stroke piston-cylinder units are necessary at both sides of the guide shaft, since a greater than usual structural height would be produced if only one piston-cylinder unit were arranged centrally, coaxially, and thus as an extension of the guide shaft. In addition, a relatively substantial distance is necessary in the lower travelling crosshead between the guide sleeves that divert the moment to the guide shaft. These demands result in a considerable structural cost.

These disadvantages have been countered by constructing the guide shaft as a plunger piston and the lower travelling crosshead as a cylinder crosshead (Journal "MPT, Metallurgical Plant and Technology", Vol. 2, 1979, pp. 5 to 14, FIG. 3). Since this no longer has the exclusive guide on the guide sleeve (plunger piston), in addition to the guidance of the travelling crosshead by means of the cylinder on the guide shaft (constructed as a plunger piston) a further guide at a distance from the first guide is necessary, for which purpose the columns connecting the upper and lower travelling crosshead are guided in the platen. In this connection the guidance of the lower travelling crosshead by means of the cylinder on the plunger piston forming the guide shaft has been found to be disadvantageous, since the bottom bush and stuffing box, which form the guide means, in the cylinder are subjected to considerable transverse forces and therefore undergo considerable wear. The inevitable abrasion of the bottom bush and stuffing box caused by the wear can cause damage to pumps and control means by way of the operating medium. A further disadvantage which should be mentioned is that the centering bore required for securing the plunger piston in the platen weakens the platen or necessitates a special reinforcement of the platen.

SUMMARY OF THE INVENTION

The object of the invention is to minimize the structural cost of forging presses of underfloor design with travelling crossheads and at the same time to keep the travelling frame guide separate from the working (plunger) piston-cylinder unit. This object is attained in that in a forging press of underfloor design with a travelling frame and a guide shaft connected to the platen and acting as a guide for the travelling crosshead, the guide shaft is hollow and acts as the cylinder for a working piston, the lower travelling crosshead of the travelling frame is guided on the hollow guide shaft, and the working piston is guided in the cylinder cavity of the guide shaft and is supported on the lower travelling crosshead by means of a thrust rod interposted between ball-and-socket joints. While retaining its guiding function, the hollow guide shaft is at the same time the cylinder for the working piston, without additional structural height or structural outlay being necessary, the working piston being guided free of transverse force in the cylinder independently of the guide of the travelling frame on account of being supported by way of a thrust rod on the lower travelling crosshead.

In known manner, two guides can be arranged along the guide shaft spaced at a distance apart for absorbing the moment resulting from eccentric forging resistance, the length of the guide shaft having to correspond to the value determined by the spacing of the guides and the length of the guides plus the maximum press stroke.

In order to reduce the structural height of the forging press further, however, according to a further feature of the invention the travelling frame can be guided on the guide shaft by means of only one guide between the lower travelling crosshead and the guide shaft, if additional guides are provided between the platen and the columns connecting the travelling crossheads, the length of the guide shaft then having to correspond to the length of the guide plus the maximum press stroke. Against the advantage of lower structural height must be set the disadvantage that the columns must be subjected to bending stresses on account of the transverse force.

The guides can be constructed as round, flat or rolling-contact guides with appropriate guide means; the guide means may be secured to the guide shaft or in the lower travelling crosshead.

Embodiments of the invention are illustrated in the drawings by way of example only.

DESCRIPTION OF PREFERRED EMBODIMENTS

Figure 1:
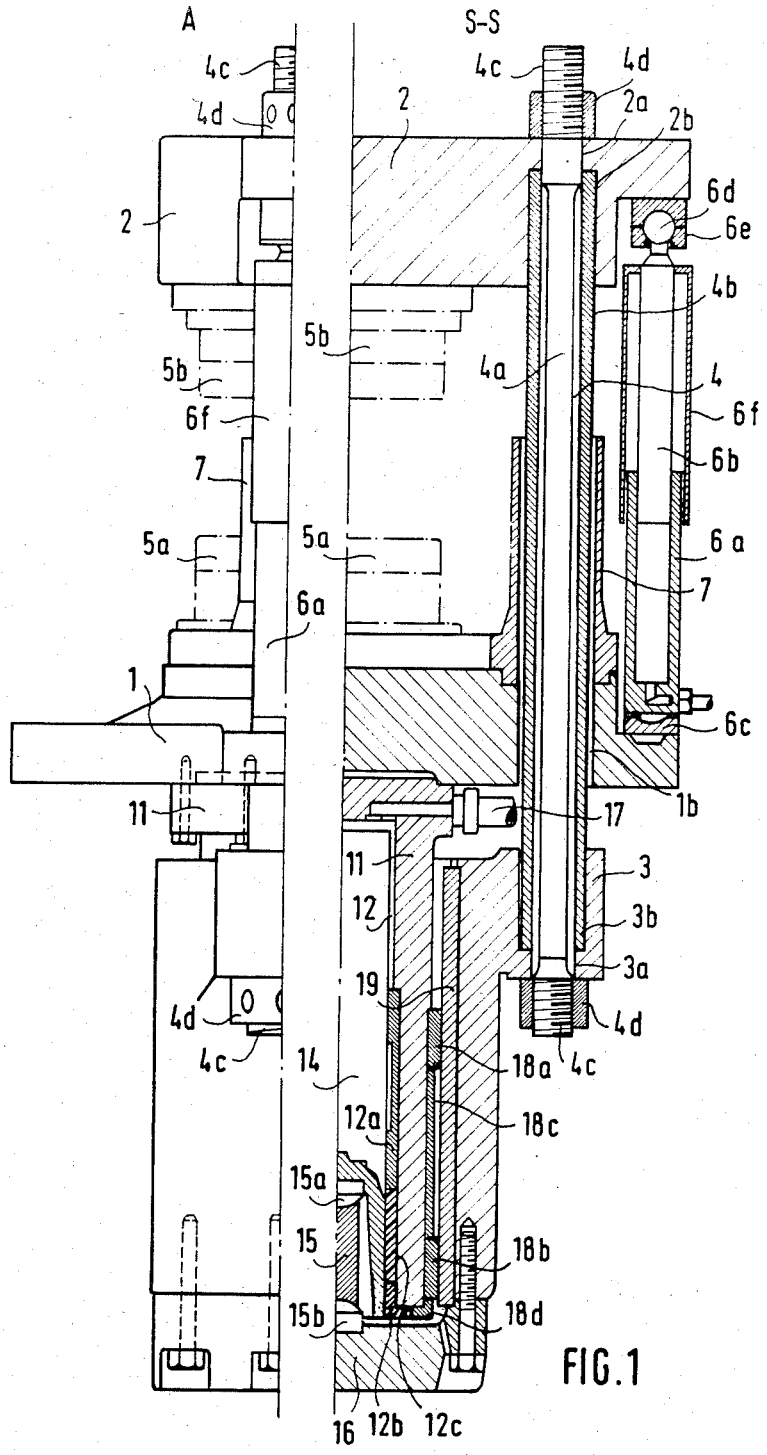
FIGS. 1 to 3 show respective different embodiments of the invention; each figure shows in the left-hand half an elevation A (see FIG. 4) and in the right-hand half in a section along the line S—S of FIG. 4.

The forging press illustrated in FIG. 1 comprises a platen 1 which is secured by way of a support plate (not shown) in a base (likewise not shown). A travelling frame, which comprises an upper travelling crosshead 2, a lower travelling crosshead 3 and columns 4 joining the latter, is movable relative to the platen 1 in the vertical direction.

In this embodiment each column 4 is formed by a tie rod 4*a* transmitting tension and a sleeve 4*b* surrounding the tie rod 4*a*. The sleeves 4*b* are inserted in bores 2*b* in the upper travelling crosshead 2 and 3*b* in the lower travelling crosshead 3 with a slight degree of tension and thus connect the two travelling crossheads 2 and 3 to form a torsionally rigid travelling frame, while the tie rods 4a pass through the smaller shouldered bores 2a and 3a in the upper travelling crosshead 2 and the lower travelling crosshead 3 and are prestressed against the sleeves 4b by threaded nuts 4d mounted on threaded studs 4c at both ends of the tie rods 4a and transmit the pressing force during operation. A lower press saddle 5a is secured to the platen 1 and the upper saddle 5b to an upper travelling crosshead 2. Piston-cylinder units, which each consist of a cylinder 6a and a plunger piston 6b and which operate between the platen 1 and the upper travelling crosshead 2, are provided for retracting the press. Each cylinder 6a is supported on the platen 1 by means of a thrust cup 6c inserted in the platen 1, while each plunger piston 6b has a spherical head 6d held by a spherical socket 6e secured to the upper travelling crosshead 2. A protection tube for each plunger piston 6b is designated 6f. A further protection tube 7 is used to protect the columns 4 and is secured on the platen 1 above the through bores 1b for the columns 4.

Figure 2:
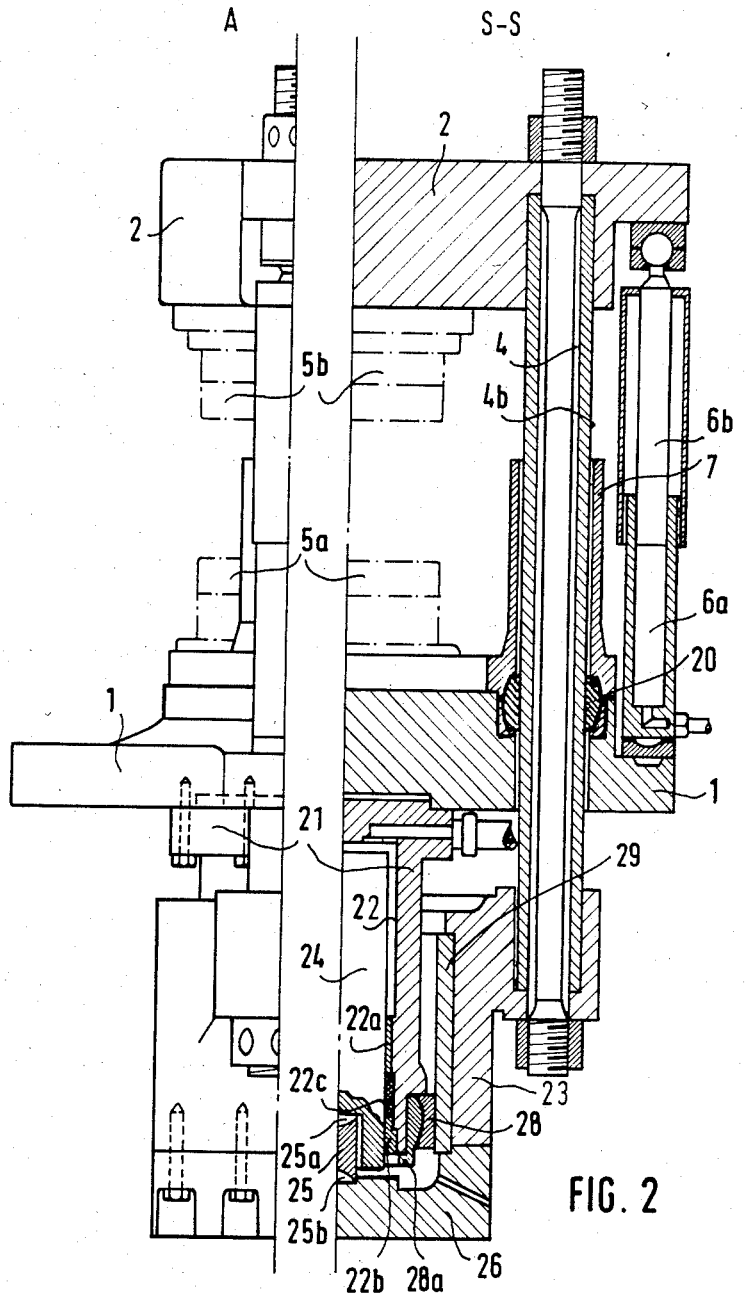
Figure 3:
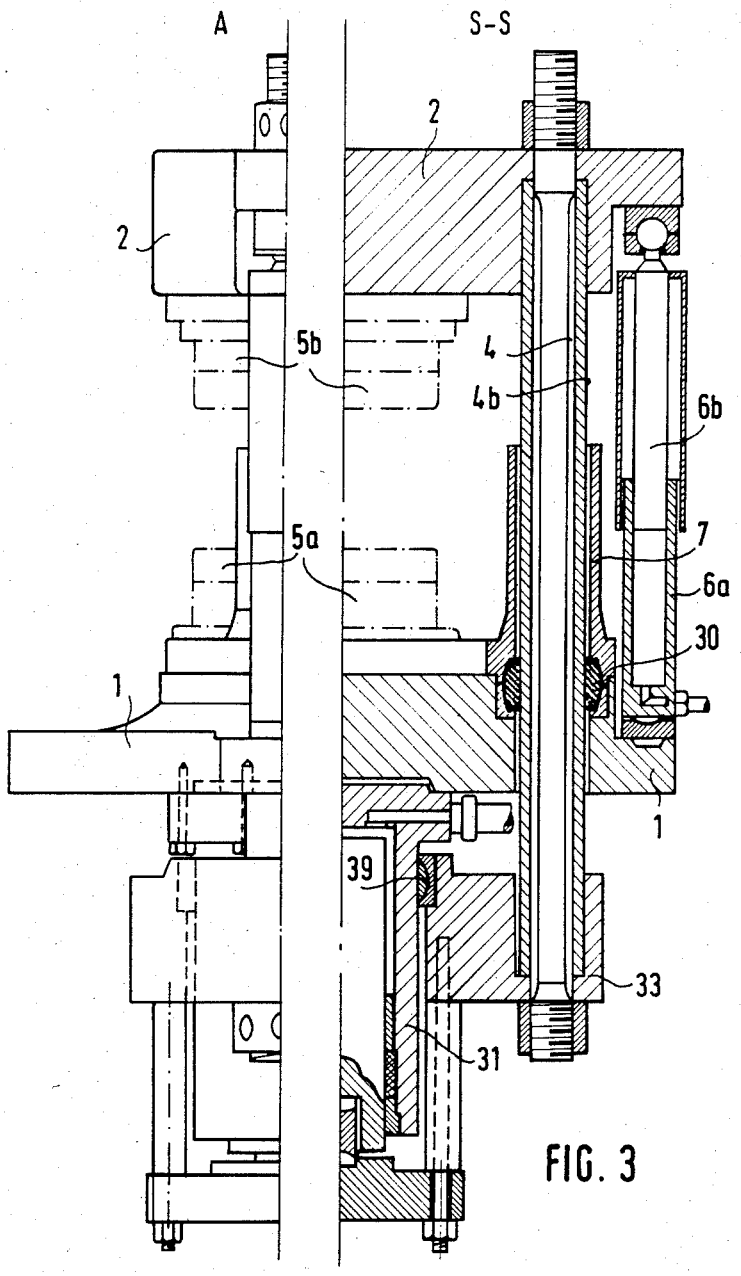
Figure 4:
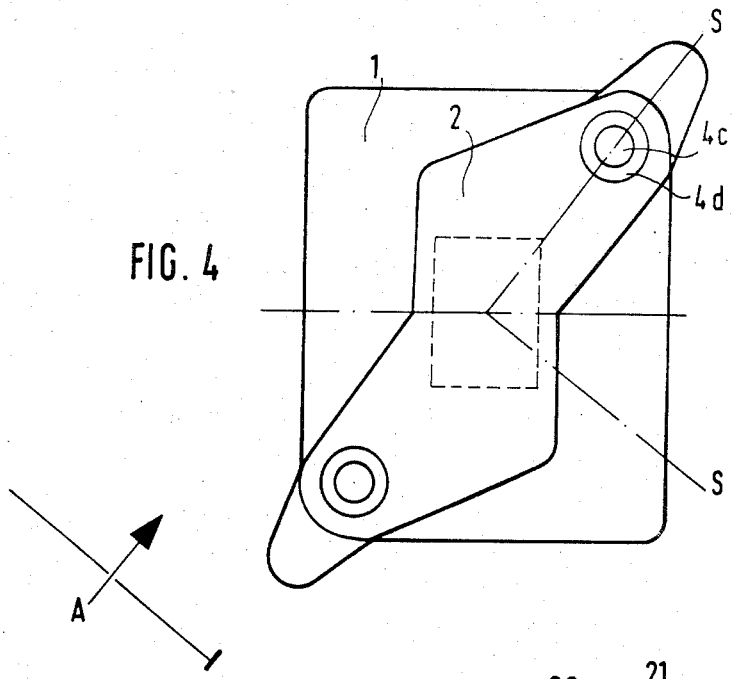
FIG. 4 shows a plan view common to all embodiments.

The forging presses illustrated in FIGS. 2 and 3 correspond to the forging press illustrated in FIG. 1 in the details described above, and so the corresponding components are provided with the same reference numerals so that repetition of the description is unnecessary.

In the case of the forging press illustrated in FIG. 1 a guide shaft 11, which is provided with a cylinder bore 12, i.e. made hollow, is connected to the platen 1. A guide sleeve 12a in the cylinder bore 12 guides a plunger piston 14, which projects into the cylinder bore 12 and is supported on the travelling crosshead 3 by way of a thrust rod 15 and a bridge member 16 closing the travelling crosshead 3 at the bottom. In order to seal the plunger piston 14 in the cylinder bore 12 a stuffing box 12b with a packing 12c is provided. The thrust rod 15 is provided at both ends with spherical recesses and is supported by way of spherical thrust members 15a and 15b with respect to the plunger piston 14 at one end and with respect to the bridge member 16 of the lower travelling crosshead 3 at the other end. The pressure medium is supplied to the cylinder bore 12 by way of a line 17.

On the outside of the guide shaft 11 are provided guide sleeves 18a and 18b and between the latter a spacing sleeve 18c, which are held in the axial direction by a thrust collar 18d. With its guide sleeves 18a and 18b the guide shaft 11 guides the travelling crosshead 3 covered internally with a sleeve 19 and, by way of the guide sleeves 18a and 18b, it also absorbs the moment resulting from eccentric forging resistance.

Figure 1A:
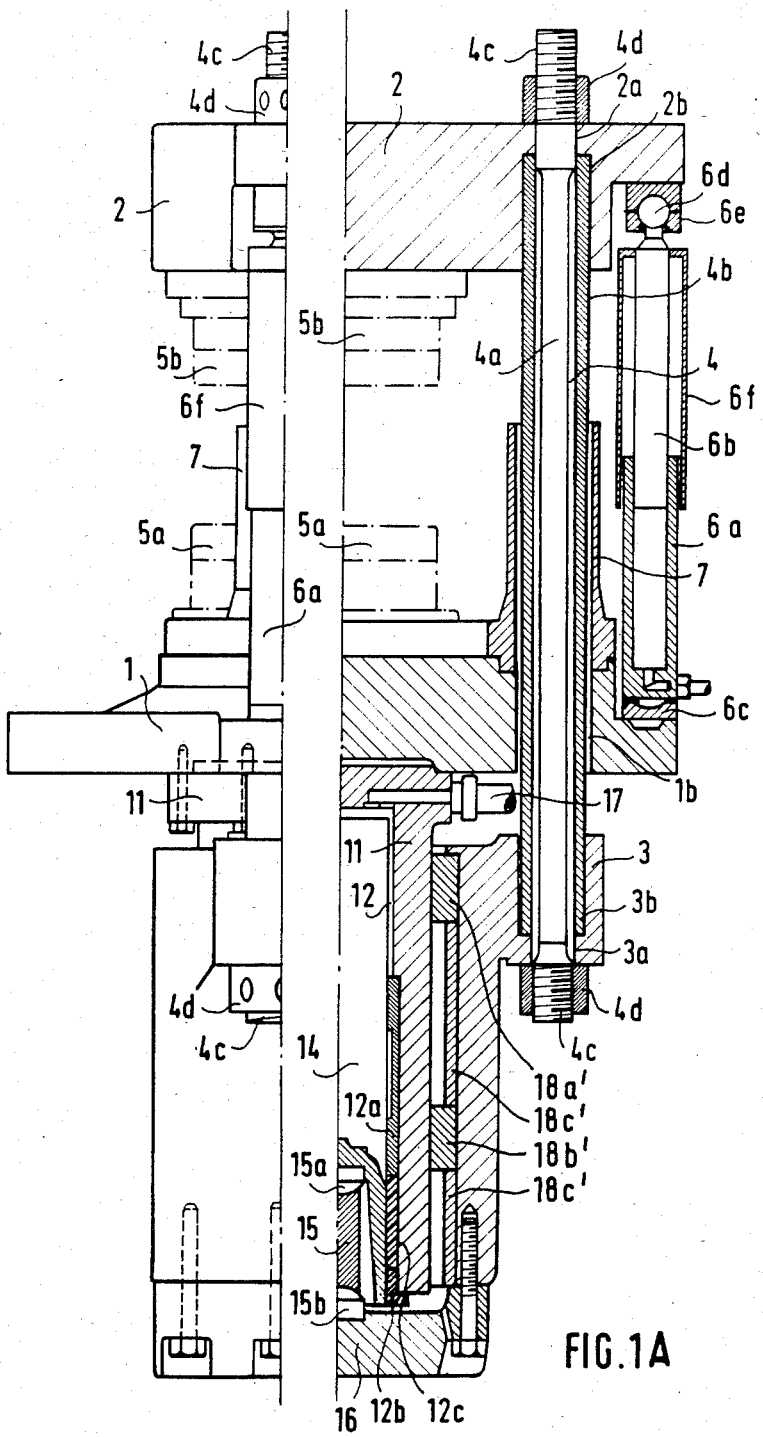

In the forging press according to FIG. 1, guides for the travelling crosshead are mounted on the guide shaft. As an alternative, guides for the travelling crosshead can be secured in the travelling crosshead, being movable along the guide shaft. Thus, by way of example, FIG. 1A shows a modification of the press according to FIG. 1, the only difference being that guide sleeves 18a', 18b' and spacing sleeve 18c' are mounted in the travelling crosshead 3 and slide with the travelling crosshead along the guide shaft 11.

In the case of the forging press illustrated in FIG. 2 a guide shaft 21, which is shorter than the guide shaft 11 and which is provided with a cylinder bore 22, i.e. made hollow, is connected to the platen 1. A guide sleeve 22a in the cylinder bore 22 guides a plunger piston 24, which extends into the cylinder bore 22 and is sealed in the cylinder bore 22 by a stuffing box 22b and a packing 22c. A bridge member 26, which closes the travelling crosshead 23 at the bottom, is provided in order to seal the plunger piston 24 on the travelling crosshead 23 and a thrust rod 25 with spherical recesses at both ends is provided between spherical thrust members 25a and 25b.

In the embodiment according to FIG. 2 only one guide 28 is provided on the outside of the relatively short guide shaft 21 at the lower end thereof, and it is secured by the retaining ring 28a. The guide 28 (cf. also FIG. 5) comprises an inner ring 28b with a spherical outer surface and two outer rings 28c joined together and enclosing the inner ring 28b between them and having a correspondingly spherical inner surface. The inner ring 28b and the outer rings 28c thus together form a ball-and-socket bush. The lower travelling crosshead 23, covered internally with a sleeve 29, has a first guide on the guide shaft 21 via the guide 28 at the end of the guide shaft 21, while the second guide is effected by way of the columns 4 of the travelling frame. For this purpose, in the embodiment according to FIG. 2, ball-and-socket bushes 20 are disposed in the platen 1 and are held by the protecting tubes 7. The moment resulting from an eccentric forging resistance is thus absorbed by the guides 28 and the ball-and-socket bushes 20, so that although the sleeves 4b of the columns 4 undergo a bending stress the structural height of the forging press is less than that of the embodiment according to FIG. 1.

The embodiment according to FIG. 3 essentially corresponds to the embodiment according to FIG. 2. The guide shaft 31, which is likewise kept relatively short is machined on its external diameter in such a way that it acts as a guide for a ball-and-socket bush 39 which is inserted in the bore of the lower travelling crosshead 33 and is held therein. The travelling crosshead 33 is provided with a second guide by the ball-and-socket bushes 30 disposed in the platen 1 by way of the sleeve 4b of the columns 4 of the travelling frame. The advantage of reduced structural outlay of this embodiment is offset by the fact that the distance between the guides 39 and 30 changes during the press stroke.

Figure 5:
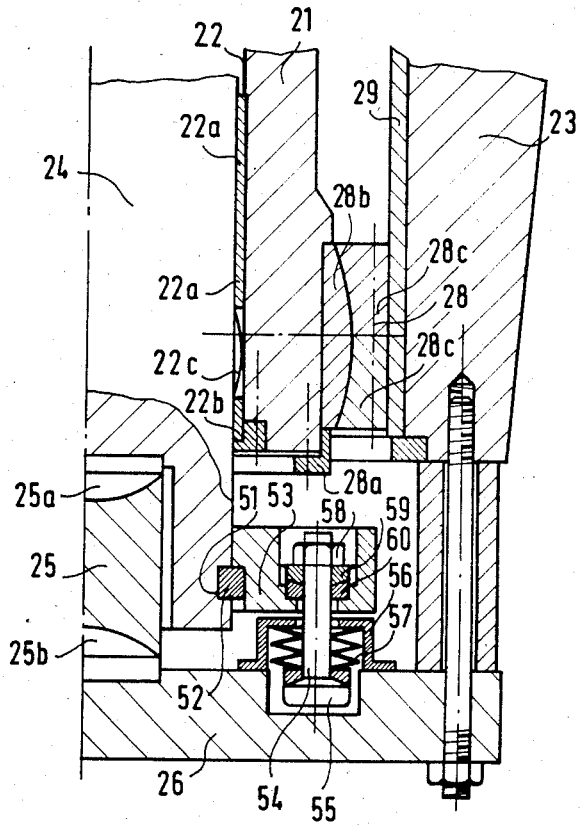
FIG. 5 shows a detail of a modification of FIG. 2 on a larger scale.

As the travelling frame is lowered by exhausting the pressure medium from the retraction cylinders 6a, the working piston 14 according to FIG. 1, or 24 according to FIG. 2, could remain in its upper position and thus lose contact with the thrust rod 15 or 25 and the bridge member 16 or 26 to the lower travelling crosshead 3 or 23, if the working piston 14 or 24 is not simultaneously acted upon with pressure medium. FIG. 5 shows—with reference to a modification of the forging press according to FIG. 2—how this can be counteracted. For this purpose the plunger piston 24 is provided at its lower end with a tapping 51 into which annular sectors 52 are inserted which bear a thrust collar 53. A plurality of suspended tie rods 54 are arranged between the said thrust collar 53 and the bridge member 26 of the lower travelling crosshead 23. A stack of springs 57, which is tensioned by a nut 58, is enclosed between the head 55 of each suspended tie rod 54 and a holding cap 56 which is secured to the bridge member 26. The tension of the stack of springs 57 is transmitted by the nuts 58 to the thrust collar 53 by way of supporting washers 59, 60 and thus holds the working piston 24 by way of the thrust rod 25 and the thrust members 25a and 25b bearing against the bridge member 26 of the lower travelling crosshead 23. The working piston 24 is thus given its mobility in order to be able to be set in the cylinder bore 22 or the guide sleeve 22*a*.

It is to be understood that the above description and the accompanying drawings are illustrative but not limitative of the invention, which is defined solely by the claims.

We claim:

1. A forging press of underfloor design comprising a static platen, a travelling frame formed by an upper travelling crosshead, a lower travelling crosshead and columns inter-connecting the said travelling crossheads, a guide shaft connected to the platen and acting as a guide for the lower travelling crosshead, at least one working piston-cylinder unit acting between the platten and the lower travelling crosshead for exerting forging pressure, and retraction piston-cylinder units acting between the platten and the upper travelling crosshead for retracting the travelling frame, characterised in that the guide shaft is made hollow and serves as the cylinder for the working piston of the said working piston-cylinder unit, the lower travelling crosshead is guided on the said hollow guide shaft, and the working piston is guided in the cylinder cavity of the said hollow guide shaft and is supported on the lower travelling crosshead by means of a thrust rod interposed between ball-and-socket joints.

2. A forging press according to claim 1, further including guide means for the lower travelling crosshead on the guide shaft, comprising two guides spaced along the guide shaft for absorbing a moment resulting from an eccentric forging resistance, the length of the guide shaft corresponding to a value determined by the spacing between and the length of the guides plus the maximum press stroke.

3. A forging press according to claim 1 further including guide means for the travelling frame comprising one guide provided between the lower travelling crosshead and the guide shaft, and additional guides provided between the platten and the said columns, the length of the guide shaft corresponding to the length of the said one guide plus the maximum press stroke.

4. A forging press according to claim 2 characterized in that the said two guides are secured to the guide shaft and the lower travelling crosshead is movable with respect to these guides.

5. A forging press according to claim 3 in which the said one guide is secured to the guide shaft and the lower travelling crosshead is movable with respect to the said guide.

6. A forging press according to claim 4, characterised in that a guide sleeve is provided covering the lower travelling crosshead which guide sleeve has a length corresponding to the length of the guide shaft and has a bore in which the said two guides slide.

7. A forging press according to claim 4, characterised in that a guide sleeve is provided covering the lower travelling crosshead which guide sleeve has a length corresponding to the length of the guide shaft and has a bore in which the said one guide slides.

8. A forging press according to claim 2 characterised in that the said guide for the lower travelling crosshead on the guide shaft is or are secured in the lower travelling crosshead and is or are movable along the guide shaft.

9. A forging press according to claim 1, characterised in that the working piston is clamped in a resilient manner against the lower travelling crosshead.

10. A forging press according to claim 9, characterised in that the working piston has a lower end which is hollow for receiving the thrust rod and a spherical thrust member, is disposed between the thrust rod and the hollow lower end of the piston, a thrust collar is joined to the said lower end, suspended tie rods are disposed between the said collar and the lower travelling crosshead compression springs are interposed between the said collar and lower travelling crosshead, and a spherical thrust member is provided in the lower travelling crosshead for supporting the thrust rod against the pressure of the springs.

11. A forging press comprising: a first crosshead; a frame composed of a second crosshead, a third crosshead, and columns interconnecting the second and third crossheads, the frame being disposed with the first crosshead between the second and third crossheads and being movable relative to the first crosshead for exerting a forging pressure on a workpiece placed in use between the first and second crossheads; a guide member extending from the first crosshead towards the third crosshead, the third crosshead being provided with a guide aperture which the guide member enters and being thereby guided on the guide member in the relative movement of the frame and the first crosshead; the guide member having an internal bore which constitutes a working cylinder of the press which bore is closed at its end adjacent the first crosshead and is open at its end remote from the first crosshead; a working piston slidably disposed in the said working cylinder; means coupling the piston non-rigidity to the third crosshead; and means for admitting a pressurised working medium to the working cylinder for acting on the piston to move the piston and thereby the third crosshead away from the first crosshead and thereby to move the second crosshead towards the first crosshead for exerting said forging pressure.

* * * * *

REEXAMINATION CERTIFICATE (1149th)

United States Patent [19]

Schubert et al.

[11] B1 4,607,518

[45] Certificate Issued Oct. 24, 1989

[54] FORGING PRESS OF UNDERFLOOR DESIGN

[75] Inventors: Hans A. Schubert, Düsseldorf; Klaus Schulze, Monchen-Gladbach, both of Fed. Rep. of Germany

[73] Assignee: SMS Hasenclever Maschinenfabrik GmbH, Dusseldorf, Fed. Rep. of Germany

Reexamination Request:
No. 90/001,752, Apr. 17, 1989

Reexamination Certificate for:

| | |
|---|---|
| Patent No.: | **4,607,518** |
| Issued: | **Aug. 26, 1986** |
| Appl. No.: | **746,323** |
| Filed: | **Jun. 19, 1985** |

[30] Foreign Application Priority Data

Jun. 19, 1984 [DE] Fed. Rep. of Germany ..... 3422644

[51] Int. Cl.[4] ..... B21J 9/12

[52] U.S. Cl. ..... 72/453.12; 72/455; 72/453.18

[58] Field of Search ..... 72/453.01, 453.12, 453.09, 72/453.18, 455; 100/269; 83/639

[56] References Cited

U.S. PATENT DOCUMENTS

| | | | |
|---|---|---|---|
| 2,893,023 | 7/1959 | Crawley et al. | 72/453.12 |
| 3,024,676 | 3/1962 | Howahr et al. | 72/453.04 |
| 3,397,568 | 8/1968 | Pahnke | 72/153 |
| 3,408,849 | 11/1968 | Jetschmann | 72/453.12 |
| 3,802,248 | 4/1974 | Ross et al. | 72/453.12 |
| 4,291,571 | 9/1981 | Claussen | 72/453.18 |

FOREIGN PATENT DOCUMENTS

| | | | |
|---|---|---|---|
| 689069 | 10/1966 | Belgium . | |
| 1941566 | 6/1966 | Fed. Rep. of Germany . | |
| 1527226 | 6/1969 | Fed. Rep. of Germany . | |
| 1301298 | 8/1969 | Fed. Rep. of Germany | 72/453.12 |
| 2903333 | 8/1979 | Fed. Rep. of Germany . | |
| 1254198 | 7/1961 | France . | |
| 1152237 | 5/1969 | United Kingdom . | |

OTHER PUBLICATIONS

MPT, vol. 2, 1979, p. 3, "A Modern Forging Plant".

Reprint from "Stahl und Eisen", Part 15, vol. 84, Jul. 1964, pp. 913–919, Forging Press with Central Guide Shaft.

"Hydraulic Presses and Pressure-Fluid Systems", by Ernst Mueller, 3rd Ed., Springer-Ferlag, 1962, pp. 32–34.

HasenClever, "Hydraulic Multi-Purpose Presses HPVE", Nr. 65 E, Machinenfabrik HasenClever GmbH, Dusseldorf, Fed. Rep. of Germany.

*Primary Examiner*—David B. Jones

*Attorney, Agent, or Firm*—John C. Holman; Marvin R. Stern; Randall G. Erdley

[57] ABSTRACT

In a forging press of underfloor construction, the vertically traveling frame has a lower crosshead which fits around and is guided on a hollow guide shaft which projects downwards from the table crosshead or platten of the press. The hollow guide shaft serves also as the working cylinder of the press. A working plunger piston which is slidable in the cylinder is coupled to the lower traveling crosshead of the press frame through spherical jointing to eliminate transverse forces on the piston.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-11 are determined to be patentable as amended.

1. [A] *In a* forging press of underfloor design comprising a static platen, a travelling frame formed by an upper travelling crosshead, a lower travelling crosshead and columns inter-connecting the [said] travelling crossheads, a guide shaft connected to *and depending from* the platen and acting as a guide for the lower travelling crosshead, at least one working piston-cylinder unit acting between the [platten] *platen* and the lower travelling crosshead for exerting forging pressure, and retraction piston-cylinder units acting between the [platten] *platen* and the upper travelling crosshead for retracting the travelling frame, [characterised in that] *the improvement wherein* the guide shaft is [made] hollow [and serves as the] *to provide the* cylinder [for the working piston] of [the] said working piston-cylinder unit, the lower travelling crosshead is *provided with an aperture which encircles the hollow guide shaft and through which the hollow guide shaft extends downwardly, said lower travelling crosshead is* guided on [the] said hollow guide shaft, *the lower travelling crosshead has a lower end, a bridge member is provided on said lower end of the lower travelling crosshead spanning said aperture,* and the working piston *of the working piston-cylinder unit* is guided in [the] *said* cylinder [cavity] of [the] said hollow guide shaft and is supported on [the lower travelling crosshead] *said bridge member* by means of *ball and socket joints and* a thrust rod interposed between *said* ball-and-socket joints.

2. A forging press according to claim 1, *and* further including guide means for the lower travelling crosshead on the guide shaft, comprising two guides spaced along the guide shaft for absorbing a moment resulting from an eccentric forging resistance, the length of the guide shaft corresponding to a value determined by the spacing between [and] the length of [the] *said two* guides plus the maximum press stroke.

3. A forging press according to claim 1 *and* further including guide means for the travelling frame comprising one guide provided between the lower travelling crosshead and the guide shaft, and additional guides provided between the [platten] *platen* and [the] said columns, the length of the guide shaft corresponding to the length of [the] said one guide plus the maximum press stroke.

4. A forging press according to claim 2 [characterized in that the] *wherein* said two guides are secured to the guide shaft and the lower travelling crosshead is movable with respect to [these] *said two* guides.

5. A forging press according to claim 3 [in which the] *wherein* said one guide is secured to the guide shaft and the lower travelling crosshead is movable with respect to [the] said *one* guide.

6. A forging press according to claim 4, [characterised in that] *wherein* a guide sleeve is provided [covering] *on* the lower travelling crosshead *surrounding said aperture,* which guide sleeve has a length corresponding to the length of [the guide shaft] *said aperture* and has a bore in which [the] said two guides slide.

7. A forging press according to claim [4]*5*, [characterised in that] *wherein* a guide sleeve is provided [covering] *on* the lower travelling crosshead *surrounding said aperture,* which guide sleeve has a length corresponding to the length of [the guide shaft] *said aperture* and has a bore in which [the] said one guide slides.

8. A forging press according to claim 2 [characterised in that the] *wherein* said [guide] *two guides* for the lower travelling crosshead on the guide shaft [is or] are secured in the lower travelling crosshead and [is or] are movable along the guide shaft.

9. A forging press according to claim 1, [characterised in that] *wherein* the working piston is clamped in a resilient manner against [the lower travelling crosshead] *said bridge member.*

10. A forging press according to claim 9, [characterised in that] *wherein* the working piston has a lower end which is hollow for receiving [the] *said* thrust rod [and], a spherical thrust member[,] is disposed between [the] *said* thrust rod and [the] *said* hollow lower end of the piston, a thrust collar is joined to [the] said lower end, suspended tie rods are disposed between [the] said *thrust* collar and [the lower travelling crosshead] *said bridge member,* compression springs are interposed between [the] said [collar] *tie rods* and [lower travelling crosshead]*said bridge member,* and a spherical thrust member is provided in [the lower travelling crosshead] *said bridge member* for supporting [the] *said* thrust rod against the pressure of [the] *said* springs.

11. A forging press comprising: a first crosshead; a frame composed of a second crosshead, a third crosshead, *below said second crosshead,* and columns interconnecting the second and third crossheads, the frame being disposed with the first crosshead between the second and third crossheads and being movable relative to the first crosshead for exerting a forging pressure on a workpiece placed in use between the first and second crossheads; a guide member extending *downwardly* from the first crosshead towards the third crosshead, the third crosshead being provided with a guide aperture which the guide member enters and being thereby guided on the guide member in the relative movement of the frame and the first crosshead; the guide member having an internal bore which constitutes a working cylinder of the press which bore is closed at its end adjacent the first crosshead and is open at its end remote from the first crosshead; a working piston slidably disposed in [the] said working cylinder; *a bridge member provided on the third crosshead below said third crosshead and spanning said aperture, said bridge member extending below said cylinder and said piston; thrust* means coupling the piston non-ridigity to [the third crosshead]*said bridge member;* and means for admitting a [pressurised] *pressurized* working medium to the working cylinder for acting on the piston to move the piston and thereby [the] *said bridge member and said* third crosshead away from the first crosshead and thereby to move the second crosshead towards the first crosshead for exerting said forging pressure.

* * * * *